United States Patent [19]

Dessau

[11] Patent Number: 4,547,609

[45] Date of Patent: Oct. 15, 1985

[54] MULTI-STAGE PROCESS FOR THE CONVERSION OF OLEFINS INTO HIGH VISCOSITY LUBRICANTS

[75] Inventor: Ralph M. Dessau, Middlesex, N.J.

[73] Assignee: Mobil Oil Corporation, New York, N.Y.

[21] Appl. No.: 700,364

[22] Filed: Feb. 11, 1985

Related U.S. Application Data

[63] Continuation-in-part of Ser. No. 533,722, Sep. 19, 1983, abandoned.

[51] Int. Cl.[4] ..... C07C 2/02

[52] U.S. Cl. ..... 585/517; 585/533

[58] Field of Search ..... 585/517, 533

[56] References Cited

U.S. PATENT DOCUMENTS

| | | | |
|---|---|---|---|
| 3,972,832 | 8/1976 | Butter et al. | 252/437 |
| 4,211,640 | 7/1980 | Garwood et al. | 208/255 |
| 4,324,940 | 4/1982 | Dessau | 585/466 |
| 4,414,423 | 11/1983 | Miller | 585/517 |

*Primary Examiner*—Curtis R. Davis

*Attorney, Agent, or Firm*—A. J. McKillop; M. G. Gilman; L. G. Wise

[57] ABSTRACT

A two-stage process is provided whereby in the first stage light olefins are converted over a shape selective acid catalyst to gasoline and distillate liquids which are then converted in a second catalytic stage under milder conditions over a small crystal acid catalyst to yield lube range products having superior viscosity index properties.

15 Claims, No Drawings

MULTI-STAGE PROCESS FOR THE CONVERSION OF OLEFINS INTO HIGH VISCOSITY LUBRICANTS

REFERENCE TO COPENDING APPLICATION

This application is a continuation-in-part of U.S. patent application Ser. No. 533,722 filed Sept. 19, 1983, now abandoned incorporated herein by reference.

BACKGROUND OF THE INVENTION

This invention relates to a two-stage process for the conversion of light olefins into high VI lubricating oils. In the first stage, light olefins are oligomerized to intermediate range products which are then further converted into heavy hydrocarbons in a second stage.

Conversion of lower olefins to gasoline and/or distillate products is disclosed in U.S. Pat. Nos. 3,960,978 and 4,021,502 (Givens, Plank and Rosinski) wherein gaseous olefins in the range of ethylene to pentene, either alone or in admixture with paraffins, are converted into an olefinic gasoline blending stock by contacting the olefins with a catalyst bed made up of a ZSM-5 type zeolite. In a related manner, U.S. Pat. Nos. 4,150,062, 4,211,640 and 4,227,992 (Garwood et al) disclose processes for converting olefins by oligomerization/polymerization to gasoline and distillate, or heavier components. In U.S. Pat. No. 4,456,779 Owen et al disclose operating conditions for the Mobil Olefin to Gasoline/-Distillate (MOGD) process for selective conversion of $C_3+$ olefins to mainly aliphatic hydrocarbons. It is recognized that crystal size of a ZSM-5 type zeolite can affect selectivity, as discussed in U.S. Pat. No. 4,324,940 (Dessau). Additionally, U.S. Pat. No. 4,021,502 discloses conversion of olefins over ZSM-12, and U.S. Pat. No. 3,827,968 discloses a two step aromatization process wherein in the first step an olefin is contacted over a ZSM-5 type zeolite.

Multi-stage processing has been found advantageous for a number of olefin upgrading processes, such as U.S. Pat. No. 4,414,423. U.S. Pat. No. 4,361,477 discloses a 2-step process wherein a catalytic dewaxer effluent containing lower olefins is stabilized by contacting such effluent with a ZSM-5 type catalyst. However, none of this prior art is directed toward the concept of the use of a dual or two-stage process wherein light olefins are converted over ZSM-5 type catalyst to gasoline and/or distillate range liquids which are then converted under milder conditions and to lubricant quality products.

SUMMARY OF THE INVENTION

The invention is directed to a process for converting light olefins into high viscosity index lubricating oils. In particular the invention is directed to a two-stage process involving a feedstock containing at least one $C_2$–$C_6$ olefin or a mixture of such olefins. In a first stage, such a feedstock is contacted under conversion conditions with a catalyst comprising a ZSM-5 type zeolite, i.e., a zeolite having a Constraint Index of from about 1 to 12 and a silica to alumina molar ratio of at least about 12. In this first stage the $C_2$–$C_6$ olefins in the feedstock are converted to form a first stage effluent containing gasoline and a distillate intermediate range hydrocarbons. At least a portion of first stage effluent is thereafter contacted in a second process stage with a catalyst also comprising a small crystal ZSM-5 type zeolite, which may have the same or different structure as the zeolite of the first stage catalyst. Low severity conversion conditions are employed in the second stage, especially lower conversion temperature, thereby producing lubricant range hydrocarbons of improved viscosity index characteristics.

DESCRIPTION OF PREFERRED EMBODIMENTS

The preferred oligomerization catalysts include the crystalline aluminosilicate zeolites having a silica to alumina ratio of at least 12, a constraint index of about 1 to 12 and acid cracking activity of about 1–200, preferably about 50–150. The preferred zeolites are sometimes known as pentasils. Representative of the ZSM-5 type zeolites are ZSM-5, ZSM-11, ZSM-12, ZSM-23, ZSM-35 and ZSM-38. ZSM-5 is disclosed and claimed in U.S. Pat. No. 3,702,886 and U.S. Pat. No. Re. 29,948; ZSM-11 is disclosed and claimed in U.S. Pat. No. 3,709,979. Also, see U.S. Pat. No. 3,832,449 for ZSM-12; U.S. Pat. No. 4,076,842 for ZSM-23; U.S. Pat. No. 4,016,245 for ZSM-35; U.S. Pat. No. 4,046,839 for ZSM-38 and U.S. Pat. No. 4,375,573 for ZSM-48. Small crystal ZSM-5 may be prepared by the method of U.S. Pat. No. 4,441,991. The disclosures of these patents are incorporated herein by reference. A suitable shape selective medium pore catalyst for fixed bed is HZSM-5 zeolite (70:1 silica to alumina) with alumina binder in the form of cylindrical extrudates of about 1–5 mm. Other catalysts which may be used in one or more reactor stages include a variety of medium pore (~5 to 9Å) siliceous materials such as borosilicates, ferrosilicates, and/or aluminosilicates disclosed in U.S. Pat. Nos. 4,414,423, 4,417,086, and silicoalumino phosphates disclosed in U.S. Pat. No. 4,440,871; incorporated herein by reference.

Depending upon crystallization conditions, the zeolites used in the catalysts of the present process may be synthesized in varying crystallite size in a known manner. In the first stage of the present process the zeolite is preferably of the large crystal type. Thus in the first stage, the crystallite diameter of the zeolite is desirably greater than about 0.5 micron and more preferably about 1–2 microns. In the second stage of the present process, it is desirable to employ catalysts containing zeolites of somewhat smaller crystallite size. Zeolites used in the second stage catalysts preferably are of crystallite diameter smaller than 0.5 micron, preferably less than 0.1 micron, and optimum conversion is obtained with HZSM-5 having a crystal size of about 0.02 to 0.05 micron.

It may be preferred to use a catalyst of controlled acid activity in some process embodiments embraced by the present invention. This controlled acid activity of the catalyst is attainable in any of several ways or a combination of these. A preferred method to reduce catalyst activity is to use a zeolite of high silica to alumina mole ratio, i.e., above 200, preferably above 500. Very high dilution with an inert matrix is also effective. For example, compositions of a more active form of zeolite ZSM-5 with alumina at a ratio of 5 parts of zeolite with 95 parts of the inert matrix provide a suitable catalyst as described in U.S. Pat. No. 4,152,363.

Activity of the zeolite catalysts used herein may also be reduced by thermal treatment with steam at high temperature as described in U.S. Pat. Nos. 3,965,209 and 4,106,218. Another method of reducing activity is to provide basic cations such as sodium at a significant proportion of the cationic sites of the zeolite. That technique is described in U.S. Pat. No. 3,899,544.

As noted, conversion conditions employed in the process of the present invention are important. Such conditions as conversion temperature and pressure and space velocity, etc. can determine the nature and yield of the products of the process. Conversion conditions in the first stage of the present process will generally include an average conversion temperature of 500° (260° C.) or higher. Preferably, conversion temperature in the first stage ranges between 500° F. and 800° F. (260° C. and 425° C.), more preferably between 550° F. and 750° F. (290° C. and 400° C.). Conversion pressure in the first stage can range from about atmospheric (101 kPa) up to about 2000 psig (13891 kPa) and is more preferably greater than atmospheric (101 kPa), i.e., from greater than atmospheric (101 kpa) to about 650 psig (4583 kPa).

The low severity conversion conditions under which the second stage of the present process is carried out are generally milder in terms of temperature than conditions in the first process stage. Temperature in the second stage can, for example, range from about 200° F. to 500° F. (100° C. to 260° C.), more preferably from about 300° F. to 450° F. (150° C. to 230° C.). Conversion pressure in the second stage is preferably less than that of the first stage and can advantageously range from about atmospheric (101 kPa) to about 650 psig (4583 kPa). The weight hourly space velocity in the process can range from about 0.1 $hr^{-1}$ to about 20 $hr^{-1}$, preferably greater than about 2 $hr^{-1}$ in the first stage. The weight hourly space velocity in the second stage is advantageously less than 1.

The conversion of the light olefin feedstock will generally be carried out in the vapor-phase by contact in the reaction zones, using, for example, a fixed bed of catalyst composition under effective conversion conditions. The process stages may be conducted in either a batch or continuous flow reaction or batch in one stage and continuous flow in the other. Since contact time of reactants with catalyst will generally be much longer in the second process stage than in the first, it is frequently suitable to run the first process stage as a continuous flow reaction and the second process stage as a batch reaction.

The feedstock for the present two-stage process essentially comprises olefins of from 2 to 6 carbon atoms, such as, for example, mixtures of the $C_2$ and $C_3$ olefins, propylene and butylene. The feedstock may be comprised of a single olefin or a mixture of different olefins, preferably with a minimum of non $C_2$–$C_6$ olefinic material. The feedstock can and frequently will contain non-olefinic diluents such as $C_1$–$C_4$ paraffins and hydrogen sulfide.

The following specfic examples will serve to illustrate the process of the present invention without unduly limiting same.

The catalysts used in the specific examples were prepared by techniques known in the art and can be prepared by any convenient technique.

EXAMPLE 1

Olefinic distillate of boiling range 280°–580° F. (138° C.–304° C.), is formed according to U.S. Pat. No. 4,456,779 in 98 percent yield from a $C_3$–$C_4$ charge stock containing 62 percent olefins at 500° F. (260° C.), 1500 psig (10443 kPa), 1 hourly space velocity with gasoline recycle, and 65 percent conversion. In addition, a 2 percent yield of 98.6 viscosity index lube is produced. The catalyst used in this first stage is a large crystal size HZSM-5 zeolite having a crystal size greater than about 0.5 micron.

In the second stage 100 parts by weight of said distillate (rich in $C_{10}$–$C_{20}$ aliphatics) is then heated in an autoclave at 210° C. at autogenous pressure for 48 hours with 10 parts of a small crystal HZSM-5 catalyst having a crystal size of about 0.02–0.05 micron. The yield of 600° F.+ (316° C.+) lube product is 40 percent, and the viscosity index was 100.

EXAMPLE 2

100 parts of unhydrotreated distillate, prepared in similar manner to that of stage 1 in Example 1, containing 8 percent 600° F.+ (316° F.+) material is reacted with 10 parts of the small crystal HZSM-5 at 210° C. for 72 hours. The yield of 600° F.+ (316° C.+) lube is 57 percent and the viscosity index is 81–83. Furthermore, the yield of 750° F.+ (400° C.+) lube is 30 percent, substantially higher than observed in prior processes.

EXAMPLE 3

100 parts of distillate prepared in similar manner to stage 1 in Example 1, is reacted with 3.8 parts of HZSM-12 for 7 hours at 204° C., a 600° F.+ (316° F.+) lube yield of 34 percent is obtained, having a viscosity index of 87–92.

EXAMPLE 4

Reaction of 100 parts of distillate described in Example 2 with 4.8 parts of HZSM-23 ($Si/Al_2$-320) at 240° C. for 24 hours, results in a 18 percent yield of 600° F.+ (316° F.+) lube with a viscosity index of 113.

From the above examples it is clear that light olefins can be efficiently converted to high viscosity index lubestock having superior properties in improved yields using the two stage process of the present invention.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

I claim:

1. A two-stage catalytic process for the conversion of olefinic components in a feedstock containing at least one $C_2$–$C_6$ olefin or mixtures thereof into high viscosity index lubricating oils; the improvement comprising a first catalytic stage wherein said $C_2$–$C_6$ olefins are converted under conversion conditions comprising temperature greater than 260° C. at elevated pressure in contact with a catalyst comprising one or more members of a class of crystalline zeolites characterized by a silica/alumina mole ratio of at least 12 and a Constraint Index within the range of about 1 to about 12 having a crystal size of greater than about 0.5 micron to gasoline and distillate liquids; and a second catalytic stage wherein the effluent from said first stage is converted in the presence of a crystalline aluminosilicate zeolite catalyst which may comprise substantially the same or different chemical elements within said class of zeolites as described above having crystal size of less than about 0.5 micron under milder conditions than those of said first stage at a temperature of about 100 to about 260° C. to yield lubricant range product having improved viscosity index characteristics.

2. The process of claim 1 wherein the temperature of said first stage is greater than about 260° C. and the pressure of said first stage is greater than at atmospheric.

3. The process of claim 1 wherein the crystalline aluminosilicate catalysts are selected from the group consisting of ZSM-5, ZSM-11, ZSM-12, ZSM-23, ZSM-35, ZSM-38, ZSM-48 or mixtures thereof.

4. The process of claim 3 wherein said catalyst in said first and second stages are the same with the exception that said first stage catalyst is a larger crystal type and said second stage catalyst is a smaller size crystal type.

5. The process of claim 4 wherein the catalysts in each stage is HZSM-5.

6. The process of claim 1 wherein said feedstock contains a mixture of $C_3$ and $C_4$ olefins.

7. The process of claim 1 wherein said first stage is a continuous flow reaction and said second stage is a batch reaction.

8. The process of claim 1 wherein the lubricant product has a viscosity index of at least about 100.

9. The process of claim 1 wherein the first stage is operated at a pressure from about atmospheric to about 2000 psig, and a weight space velocity of about 0.1 to 20 $hr^{-1}$, at a temperature from about 260° C. to 425° C.

10. The process of claim 1 wherein the second stage is operated at a weight space velocity not greater than about 1 $hr^{-1}$, and a temperature of about 150° to 230° C.

11. A multi-stage process for making lubricant quality heavy hydrocarbons from lower olefins comprising the steps of contacting olefinic feedstock comprising $C_2$ to $C_6$ olefins with first large crystal shape selective medium pore acidic catalyst in a primary oligomerization reaction zone at elevated temperature and pressure to convert lower olefins to intermediate range hydrocarbons;

recovering a distillate fraction rich in $C_{10}$ to $C_{20}$ olefins from the primary reaction zone; and further reacting the distillate fraction from the primary zone under lower severity conditions in a secondary reaction zone at a temperature below about 260° C. by contacting the distillate with a second shape selective medium pore acid catalyst having a crystal size less than 0.5 micron to produce a high viscosity index lubricant quality product.

12. The process of claim 11 wherein the second catalyst comprises an aluminosilicate zeolite having a silica to alumina mole ratio of at least 12, a constraint index of about 1 to 12, and an average crystal size less than about 0.1 micron.

13. The process of claim 12 wherein the second catalyst consists essentially of HZSM-5 having a crystal size of about 0.02 to 0.05 micron and an acid cracking activity of about 50 to 200.

14. The process of claim 11 wherein both reaction zones contain ZSM-5 type zeolite, the first catalyst comprising zeolite having a crystal size greater than 0.5 micron and the second catalyst having a crystal size less than 0.1 micron.

15. A lubricant product made by the process of any of claims 1 to 14 and having a viscosity index greater than about 100.

* * * * *